US005148565A

United States Patent [19]

Devasthali

[11] Patent Number: 5,148,565

[45] Date of Patent: Sep. 22, 1992

[54] METHOD FOR MAKING A RUBBER BOOT CONTAINING HEAT REFLECTING MEANS

[75] Inventor: Prakash Devasthali, Davenport, Iowa

[73] Assignee: Norcross Footwear, Inc., Rock Island, Ill.

[21] Appl. No.: 796,852

[22] Filed: Nov. 25, 1991

Related U.S. Application Data

[62] Division of Ser. No. 522,311, May 11, 1990, Pat. No. 5,068,982.

[51] Int. Cl.[5] ..... A43B 1/10

[52] U.S. Cl. ..... 12/142 EV; 36/4

[58] Field of Search ..... 12/142 E, 142 EV, 1 F, 12/146 BR, 147 A; 36/1, 4, 72 R, 113, 84

[56] References Cited

U.S. PATENT DOCUMENTS

| | | | |
|---|---|---|---|
| 2,607,130 | 8/1952 | Pearson | 36/1 |
| 3,827,167 | 8/1974 | Jones | 36/4 |
| 3,833,951 | 9/1974 | Hurwitz | 5/345 R |
| 3,865,760 | 2/1975 | Pitts et al. | 260/2.5 AJ |
| 4,122,203 | 10/1978 | Stahl | 428/309 |
| 4,223,095 | 9/1980 | Esser et al. | 521/55 |
| 4,224,374 | 9/1980 | Priest | 428/310 |
| 4,234,341 | 11/1980 | Hiestand et al. | 106/18.22 |
| 4,616,430 | 10/1986 | McQuiggin | 12/146 BR X |
| 4,703,533 | 11/1987 | Barma | 12/142 E |
| 4,808,465 | 2/1989 | Vane | 428/233 |
| 4,813,160 | 3/1989 | Kuznetz | 36/3 B X |
| 4,842,772 | 6/1989 | Withiam | 252/601 |
| 4,858,337 | 8/1989 | Brama | 36/4 |
| 4,864,742 | 9/1989 | Grilliot et al. | 36/4 X |
| 4,908,963 | 3/1990 | Krajcir et al. | 36/72 R X |
| 5,025,575 | 6/1991 | Lakic | 36/44 |

*Primary Examiner*—Paul T. Sewell
*Assistant Examiner*—Ted Kavanaugh
*Attorney, Agent, or Firm*—Charles G. Lamb

[57] ABSTRACT

A fireboot comprising a boot having a lower portion and an upper portion. An aluminized pigment compound is vulcanized to the upper portion wherein the aluminized pigment compound is comprised of a mixture of rubber, ethylene-propylene-diene monomer, styrene-butadiene rubber, an aluminum pigment, and a liquid ethylene-propylene-terpolymer.

12 Claims, 1 Drawing Sheet

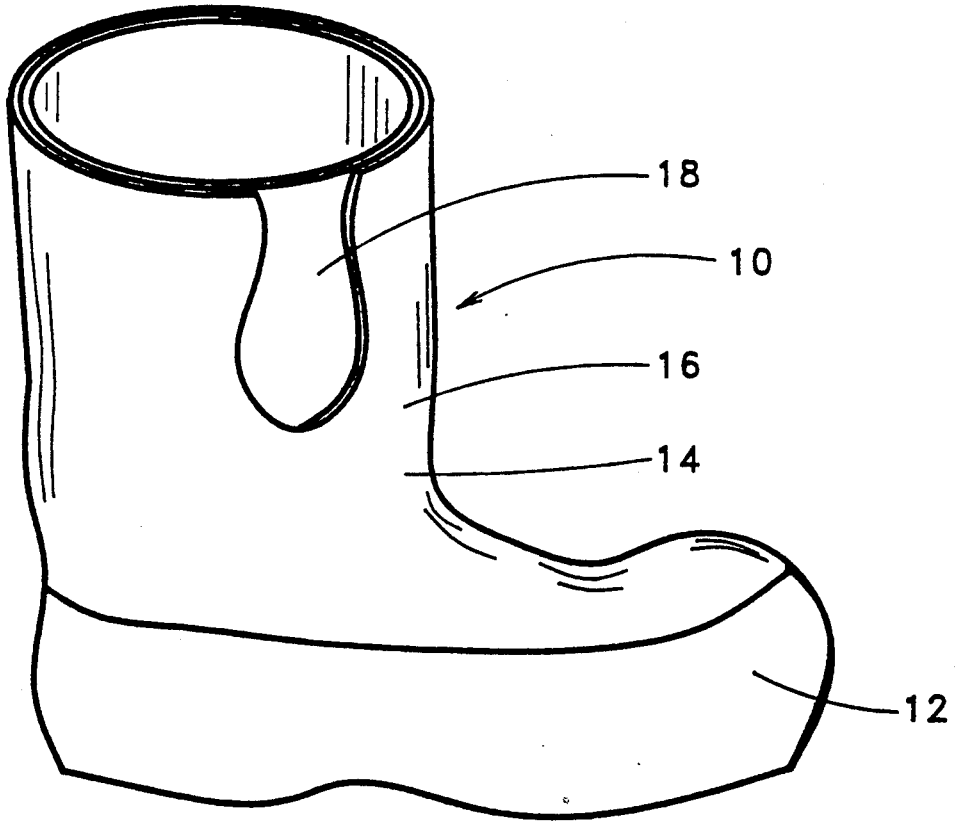
18
10
16
14
12

METHOD FOR MAKING A RUBBER BOOT CONTAINING HEAT REFLECTING MEANS

CROSS REFERENCE TO RELATED APPLICATIONS

This is a divisional application of co-pending patent application, Ser. No. 522,311, filed May 11, 1990 now U.S. Pat. No. 5,068,982.

BACKGROUND OF THE INVENTION (a) Field of the Invention

The present invention relates to a rubber compound containing an aluminum pigment. The present invention further relates to fireboots including heat reflecting means therein. The present invention even further relates to a method for making a heat reflecting fireboot.

(b) Description of the Prior Art

Presently firefighter's boots, through they perform very well in the field, have very little, if any, heat reflectivity. These boots are generally black in color, and black absorbs radiant heat as opposed to reflecting it. Efforts have been made to incorporate heat reflecting means in fireboots, but such efforts have been found to have drawbacks or disadvantages. For example, silver coatings have been applied to fireboots to enhance heat reflectivity, but flaking off of the coating made such applications impractical. Other efforts to laminate fireboots with an aluminized fabric also failed because it was expensive and problems were encountered with finding compatible adhesives to adhere the fabric to the boot.

A number of patents teach the use of aluminum compounds in rubber compositions, but none have been found acceptable for use in a fireboot For example, U.S. Pat. No. 2,607,130 teaches rubber footwear having an elastically stretchable top portion which includes a textile base of knitted stockinet fabric coated on the outside with vulcanized rubber and a light reflector mounted on the rubber coating. One light reflecting material is a metallic aluminum powder which is sprinkled into a tacky varnish layer. And, U.S. Pat. No. 3,865,760 teaches a rubber composition including an aluminum trihydrate filler. The aluminum trihydrate filler is added by stirring slowly into latex.

SUMMARY OF THE INVENTION

The present invention provides a rubber compound containing an aluminum pigment therein. Furthermore, the present invention provides a fireboot having heat reflecting properties therein. Even further, the present invention provides a method for making a heat reflecting fireboot.

More particularly, the present invention provides a fireboot comprising a boot having a lower portion and an upper portion, the upper portion having an aluminized pigmented compound vulcanized thereto, said aluminized pigmented compound comprising a mixture of rubber, ethylene-propylene-diene monomer, styrene-butadiene rubber, an aluminum pigment, and a liquid ethylene-propylene terpolymer.

More particularly, the present invention provides a method of making a fireboot comprising the steps of:

(a) heating rubber in the presence of a chemical peptizer for a period sufficient to breakdown the rubber;

(b) masticating the peptized rubber;

(c) mixing an ethylene-propylene-diene monomer with the masticated peptized rubber to form a smooth blend of rubber ethylene-propylene-diene and monomer;

(d) mixing styrene-butadiene rubber to the rubber ethylene-propylene-diene monomer mix to form a homegeneous blend;

(e) adding an aluminum pigment to the homegeneous blend to form a uniform pigmented aluminized mass of rubber;

(f) adding liquid ethylene-propylene terpolymer to the pigmented aluminized mass;

(g) adding at least one extender, activator, reinforcer antioxidant, or tack producing compound to said terpolymer pigmented aluminized mass;

(h) cooling the resulting mass to below 200° F.;

(i) adding accelerators and cross-linking agents to said mass;

(j) calendering said mass;

(k) adding said mass to upper portions of a boot; and (l) vulcanizing said boot.

BRIEF DESCRIPTION OF THE PREFERRED EMBODIMENT

With reference to the Figure, there is shown a fireboot, generally denoted as numeral 10, of the present invention which includes a lower portion 12 and an upper portion 14. The upper portion 14 consists of an inner layer 18 and an outer layer 16.

The lower portion 12 and the inner layer 18 are generally unitary in construction and made from natural and/or synthetic rubber-like materials. The outer layer 16 of the upper portion 14 is a rubber compound containing an aluminized pigment which has been vulcanized to the inner layer 18.

One preferred outer layer 16 is prepared by peptizing from about 99.0 to 98.75 per cent by weight of natural rubber (NR) with from about 0.25 to 1.00 per cent by weight of a chemical peptizer in a cracker at a temperature of from about 240° F. to 275° F. for about 4 to 6 minutes. More preferably, the natural rubber will be from 99.5 to 99.7 per cent by weight and the chemical peptizer will be from 0.25 to 0.50 per cent by weight.

From about 35 to 40 parts by weight of the resulting peptized natural rubber is first masticated on a two roll mill until a smooth band is formed on the front roll. Water on the front as well as the bank rolls is adjusted such that the roll temperature does not exceed 200° F. From about 10 to 15 parts by weight of ethylene-propylene-diene monomer (EPDM) and preferably from about 18 to 20 parts by weight with a Mooney viscosity in the range of 45 to 55 is added on the mill and allowed to blend in with the already formed smooth band of natural rubber. The temperature is generally controlled between 175° F. and 200° F. and uniform blending is obtained by taking triangular cross cuts and allowing the cut portion to enter the nip of the mill. During this process the nip of the mill is adjusted so that there is an adequate rolling back allowing proper shear and mixing of natural rubber and EPDM.

From about 6 to 10 parts by weight of styrene-butadiene rubber (SBR) and preferably from about 11 to 12 parts by weight is added to the smooth blend in the same manner as the EPDM until a smooth homogeneous blend of NR, EPDM and SBR is obtained. To the above homogeneous blend from about 2 to 4 parts by weight of a aluminum pigment dispersion and preferably from about 3 to 4 parts by weight is added. Triangular crosswise cuts are taken and passed through the nip of the mill until the pigment is uniformly distributed through the mass of the rubber blend.

To this uniform pigmented aluminized mass of rubber from about 5 to 7 parts by weight liquid ethylene propylene terpolymer (EPT) and preferably from about 6 to 7 parts by weight is added. This liquid polymer is used to facilitate easy processing and to gain some building tack needed for boot building operation. This entire mass is then allowed to mix until the added liquid polymer is completely blended. Again precaution is taken that the temperature of the mass does not exceed 250° F. and is generally controlled at from about 175° F. to 200° F. Preferably, to this mass, rubber fillers are added in order to facilitate easy processing and reduce the cost of the compound. Examples of fillers include extenders, activators, antioxidants, and compounds that promote tackiness. Generally these compounds are from about 40 to 50 per cent by weight of the total compound, and usually do not exceed 44 per cent by weight.

When fillers are added to the uniformly pigmented blend of NR/EPDM/SBR, the preferred additions are uniformly blended in with the extenders being first, activators second, antioxidants third, and lastly, compounds that promote tackiness. These ingredients are added to the rubber blend uniformly over the mill. These ingredients are added to the rubber blend uniformly over the mill. The mixing is continued until the fillers are uniformly incorporated and no particulate specs are visible in the blend. This generally takes 3 to 4 passes of the entire mass over the mill. If the temperature of the mass goes over 240° F., then the entire mass is cooled to less than 200° F. The mass is passed back through the mill to get a smooth band with rolling back. After a smooth band is obtained an acceleration package is then added.

This is generally an accelerator which has a rather short scorch time in combination with an accelerator with a low cure rate and medium scorch time, and a crosslinking agent. This aluminized compound outer layer 16 is then calendered and vulcanized to the inner layer 18. Generally, the vulcanization is carried out in an autoclave at a temperature of from about 275° F. to 300° F. and 27 to 30 psi for 45 to 75 minutes. Preferably, the temperature will be above 295° F. and the vulcanization time will be from about 60 to 62 minutes.

In the practice of the present invention, chemical peptizing compounds which have been found useful include, but are not limited to mercaptan modifiers, including xylyl mercaptan, napthyl-B-mercaptan, and pentachlorothiophenol. Generally, these compounds are from about 0.25 to 1.00 per cent by weight in the aluminized pigment outer layer 16 and preferably, are less than 0.50 per cent by weight.

Extenders useful in the present invention include, particularly products which are inexpensive and compatible with the rubber compounds. One preferable extender is calcium carbonate which can be added in an amount up to 35 weight per cent of the outer layer 16.

Activators that are useful in the present invention, include, but are not limited to zinc oxide, stearic acid, and the like. Generally, these compounds are from about 1 to 5 per cent by weight, preferably from about 2 to 4 per cent by weight, in the aluminized pigment outer layer 18. Metal oxides and particularly zinc oxide, are preferred activators. These oxides are reinforcers in the vulcanization step, giving excellent processing properties and additionally low heat build up.

Another group of preferred activators include fatty acids, such as stearic acid, and the like. These compounds activate the breaking of accelerator-sulfur bonds and in turn increase the rate of vulcanization. Furthermore, they act as lubricants and plasticizers in the formulation and are from about 0.25 to 1.25 per cent by weight in the outer layer 16. Preferably these compounds will be less than 0.75 per cent by weight in the outer layer 18.

Antioxidants that may be used in the present invention are those compatible with the NR/EPDM/SBR/EPT mix. These include, but are not limited to, phenols, such as polyphenolic compounds, or aldehyde-amines, ketone-amine reaction products, and the like. One preferred polyphenolic compound is the butylated reaction product of P-cresol and dicyclopentadiene which has a molecular weight in the range of 600 to 700. The amount of antioxidant is generally from about 0.50 to 1.0 per cent by weight of the aluminized pigment in the outer layer 16.

Compounds that increase tackiness in the product of the present invention are also useful. These include, for example, synthetic resins, abietic acid, dehydroabietic acid, and the like. These compounds are generally from about 1 to 2 per cent by weight of aluminized pigment product.

Accelerators for the reaction between the NR/EPDM/SBR/EPT mix are also useful in the present invention. These include those compounds that have short scorch times, increase rate and efficiency of crosslinking, low cure rates, and crosslinking agents. Generally, these compounds are from about 0.5 to 1.0 per cent by weight of the total aluminized pigment product. Preferred accelerators include, for example, mercaptobenzothiozole disulfide, benzothiozyl disulfide, diphenyl guanidiene, sulfur, and the like.

A more comprehensive understanding of the invention can be obtained by considering the following examples. However, it should be understood that the Examples are not intended to be unduly limitative of the invention.

EXAMPLES 1-7

The following examples demonstrate the procedure that was followed in preparing an aluminized pigment composition and then utilizing the composition in a fireboot.

EXAMPLE 1

About 70 pounds of natural rubber (NR) grade #1 smoke sheet was first peptized by adding 0.19 pounds of pentachlorothiophenol in a cracker at a temperature of about 245° F. for 4 minutes. From the resulting mass, 44.5 lbs. of peptized natural rubber was first masticated on a two roll mill until a smooth band was formed on the front roll. Water was added to the front roll as well as the back rolls so that the roll temperature did not exceed 200° F.

To the masticated products, 13.75 pounds of ethylene-propylene-diene monomer (EPDM) having a Mooney viscosity of 48 was added on the mill and allowed to blend in with the already formed smooth band of natural rubbers. Uniform blending was obtained by taking triangular cross cuts and allowing the cut portion to enter the nip of the mill. During this process the mill was adjusted so that there was an adequate rolling bank allowing proper shear and mixing of the NR and EPDM.

Then 8.75. lbs of styrene-bytadiene rubber (SBR) was added to the smooth blend obtained. Similar mixing procedures as for the NR, EPDM were followed to get a smooth homengeneous blend of NR, EPDM and SBR.

To the above homogeneous blend about 2.5 lbs. of aluminum pigment dispersion in the form of a slab was added and taking triangular crosswise cuts and passing through the nip of the mill the pigment was uniformly distributed through the mass of the rubber blend.

To this uniform pigment aluminized mass of rubber 7 lbs. of liquid ethylene propylene terpolymer was added. This liquid polymer facilitated easy processing and added building tack needed for a boot building operation. This entire mass was then allowed to mix until the added liquid polymer was completely blended. Again precaution was taken that the temperature of the mass did not exceed 250° F.

To this mass, rubber fillers were added. This included 37.5 lbs. of −325 mesh calcium carbonate; 3 lbs., 3 oz. of zinc oxide; 11 oz. of stearic acid; 0.75 lbs. of a butylated reaction product of P-cresol and dicyclopentadiene with an average molecular weight of 600–700; and, 1.25 lbs. of a polyterpene resin. These ingredients were added to the rubber blend uniformly over the mill. The mixing was continued until the entire amount was incorporated and no particulate specs were visible in the blend. This took 3 passes of the entire mass over the mill in which the temperature of the mass was kept below 240° F.

About 11 oz. of mercaptobenzothiozole disulfide, an accelerator was a rather short scorch time, was added. Three oz. of diphenyl guanadiene, an accelerator with low cure rate and medium scorch time was then added, and sequentially 1.75 lbs. of Crystex (sulfur) was added.

The resulting compounded aluminized rubber batch weighed 122.5 lbs. and had a specific gravity of 1.1981. This aluminized compound was calendered and vulcanized in an autoclave at 295° F. and 30 PSI for 62 minutes to an upper portion of a boot.

This fireboot had good tensile as well as aging properties. Also the boot had good heat and light reflectivity compared to conventional black fire fireboots.

EXAMPLE 2

The procedure of Example 1 was repeated except that instead of SBR, a mixture of SBR and carbon black was used. In the mixture was 4.86 pounds of SBR and 3.89 pounds of carbon black. Furthermore, instead of 2.5 lbs. of aluminum pigment, 11.25 lbs. of a slab of aluminum pigment was used. This compounded aluminum rubber was also vulcanized in the same manner as the one in Example 1 and the result was less reflectivity when compared to Example 1.

EXAMPLES 3 & 4

The procedure of Example 1 was repeated except that instead of 2.5 lbs. of aluminum pigment, 5 and 10 lbs., respectively, were used. This was done to achieve more reflectivity and shine and the results were that the fireboot had about the same reflectivity as Example 1.

EXAMPLE 5

The procedure of Example 1 was repeated except that instead of 2.5 lbs. of aluminum pigment in the form of SBR dispersion (56 per cent pigment and 44 per cent binder), 2.5 lbs. of aluminum pigment in the form of SBR dispersion (40 per cent pigment and 60 per cent binder) was used. This latter pigment was much cheaper and the result was less reflectivity when compared with Example 1.

EXAMPLE 6

The procedure of Example 1 was repeated wherein 15 to 30 pounds of "Mica" (Hydrated Aluminum Potassium Silicate) filler were incorporated into the rubber at the step of adding fillers. The result was a slight improvement of reflectivity when compared with Example 1.

EXAMPLE 7

The procedure of Example 1 was repeated except that in addition to 2.5 lbs. aluminum pigment dispersion in SBR, 4 lbs. of Silvex 450-20-E, an aluminum pigment encapsulated in resin in pellet form from Silberline Manufacturing Company was used.

In the determination of the radiant heat resistance of the aluminized boot, the radiant heat was measured in accordance with test 4–4.5 set forth in NFPA 1974-87 Edition. In order for the sample to pass the test the temperature inside the boot should not rise above 110° F. This test was conducted on the boot made of aluminized rubber and the results showed that usage of aluminum pigment in all examples does give considerable improvement over conventional black rubber fireboots.

The foregoing detailed description is given primarily for clearness of understanding and no unnecessary limitations are to be understood for modification will become obvious to those skilled in the art upon reading this disclosure and may be made without departing from the scope of the invention or scope of the appended claims.

What is claimed is:

1. A method of making a fireboot comprising the steps of:

(a) heating rubber in the presence of a chemical peptizer for a period sufficient to breakdown the rubber;

(b) masticating the peptized rubber;

(c) mixing an ethylene-propylene-diene monomer with the masticated peptized rubber to form a smooth blend of rubber ethylene-propylene-diene and monomer;

(d) mixing styrene-butadiene rubber to the rubber ethylene-propylene-diene monomer mix to form a homegeneous blend;

(e) adding an aluminum pigment to the homegeneous blend to form a uniform pigmented aluminized mass of rubber;

(f) adding liquid ethylene-propylene terpolymer to the pigmented aluminized mass;

(g) adding at least one extender activator reinforcer antioxidant, or tack producing compound to said terpolymer pigmented aluminized mass;

(h) cooling the resulting mass to below 200° F.;

(i) adding accelerators and crosslinking agents to said mass;

(j) calendering said mass;

(k) adding said mass to upper portions of a boot; and, (l) vulcanizing said boot.

2. The method of claim 1 wherein the heating rubber in the presence of a chemical peptizer is at from about 240° F. for 4 to 6 minutes.

3. The method of claim 1 wherein the chemical peptizer is selected from the group consisting of pentachlorothiophenol, xylyl mercaptan, and napthyl-B-mercaptan.

4. The method of claim 1 wherein masticating includes mixing on a two roll mill to form a smooth band.

5. The method of claim 1 wherein the mixing of the ethylene-propylene-diene occurs in a mill wherein the temperature is controlled in the range of from about 175° F. to 200° F.

6. The method of claim 1 wherein the ethylene-propylene-diene monomer has a Mooney viscosity of from about 45 to 55.

7. The method of claim 1 wherein the mixing of styrene-butadiene rubber occurs in a mill wherein the temperature is controlled in the range of from about 175° to 200° F.

8. The method of claim 1 wherein the mixing of the liquid ethylene-propylene terpolymer occurs in a mill wherein the temperature is controlled in the range of from about 175° F. to 200° F.

9. The method of claim 1 wherein the mixing of extender, activator, reinforcer, antioxidants, or tack producing compounds occur in a mill wherein the temperature is controlled in the range of from about 175° F. to 200° F.

10. The method of claim 1 wherein the accelerator and crosslinking agents occur in a mill wherein the temperature is controlled in the range of from about 175° F. to 200° F.

11. The method of claim 1 wherein the adding of said mass to upper portions occurs in an autoclave and is vulcanized at a temperature of from about 275° F. to 300° F. at a pressure of from about 27 to 30 PSI for a period of 45 to 75 minutes.

12. The method of claim 11 wherein the vulcanizing temperature is from about 295° F. to 300° F. and the vulcanizing time is from about 60 to 62 minutes.

* * * * *